US006042187A

United States Patent [19]

Conner et al.

[11] Patent Number: 6,042,187

[45] Date of Patent: Mar. 28, 2000

[54] SEAT BACK WITH APERTURE IDENTIFIERS

[75] Inventors: John P. Conner, Grandville; Steven E. Finney, Grand Rapids; Richard A. Thalen, Rockford; Robert L. Russell, Kentwood; Tim Coffield, Grand Rapids, all of Mich.

[73] Assignee: Irwin Seating Company, Grand Rapids, Mich.

[21] Appl. No.: 09/292,246

[22] Filed: Apr. 15, 1999

Related U.S. Application Data

[62] Division of application No. 08/953,474, Oct. 17, 1997, Pat. No. 5,951,110.

[51] Int. Cl.[7] ..... A47C 31/02

[52] U.S. Cl. ..... 297/452.6; 297/217.1; 5/409; 40/320; 29/91.1

[58] Field of Search ..... 297/452.14, 452.15, 297/452.46, 452.6, 218.1, 218.5, 217.1; 40/299.01, 320; 5/194, 402, 408–410; 434/407; 29/91.1, 407.01, 407.1

[56] References Cited

U.S. PATENT DOCUMENTS

| | | | |
|---|---|---|---|
| D. 201,433 | 6/1965 | Platner . | |
| 1,800,097 | 4/1931 | Nuberg . | |
| 2,499,112 | 2/1950 | Roman . | |
| 2,549,902 | 4/1951 | Hibbard et al. . | |
| 2,553,042 | 5/1951 | Hoven et al. . | |
| 2,892,489 | 6/1959 | Hurley . | |
| 3,170,729 | 2/1965 | Grant . | |
| 3,182,377 | 5/1965 | Hoven et al. . | |
| 3,288,529 | 11/1966 | Koch . | |
| 3,407,001 | 10/1968 | Minsker . | |
| 3,501,197 | 3/1970 | Burton . | |
| 3,655,239 | 4/1972 | Agosti . | |
| 3,669,496 | 6/1972 | Chisholm . | |
| 3,722,950 | 3/1973 | Harnick | 5/409 X |
| 3,734,561 | 5/1973 | Barecki et al. . | |
| 3,797,887 | 3/1974 | Barecki et al. . | |
| 3,807,800 | 4/1974 | Morrison . | |
| 3,841,704 | 10/1974 | Platner et al. . | |
| 4,073,539 | 2/1978 | Caruso . | |
| 4,088,367 | 5/1978 | Atkinson et al. . | |
| 4,123,105 | 10/1978 | Frey et al. . | |
| 4,125,285 | 11/1978 | Hanagan | 297/452.6 X |
| 4,368,917 | 1/1983 | Urai . | |

(List continued on next page.)

FOREIGN PATENT DOCUMENTS 2723722 7/1978 Germany .

OTHER PUBLICATIONS

Exhibit A is a History of Movie Theatre Seating Product Development, 1 Page; all seats depicted herein include plywood internal structure and are prior art.

*Primary Examiner*—Peter R. Brown

*Attorney, Agent, or Firm*—Van Dyke, Gardner, Linn & Burkhart, LLP

[57] ABSTRACT

A plastic contoured seat back includes an inner and an outer shell affixed together. The inner shell includes a three dimensionally curved front surface and a two dimensionally curved back surface. The inner shell may include an internal rib adjacent the top of the shell that is shaped differently from the top edge of the inner shell. The internal rib is adapted to allow the inner shell to be cut adjacent the internal rib so that the inner shell can be varied in shape. The shell may also include indentations on the back side of the shell adjacent the corners of the inner shell. The indentations are dimensioned to receive overlapping fabric that is pulled around the corners such that the fabric on the back of the shell adjacent the corners does not project outwardly more than the fabric elsewhere, despite the over lapping of the fabric at the corners. The inner shell may also include a plurality of uniquely identified holes adapted to allow a variety of different ornamentation to be attached to the inner shell.

20 Claims, 17 Drawing Sheets

U.S. PATENT DOCUMENTS 4,418,958 12/1983 Watkin .
4,498,702 2/1985 Raftery .
4,519,651 5/1985 Whitwam .
4,555,139 11/1985 Leib .
4,556,254 12/1985 Roberts .
4,572,578 2/1986 Perkins .
4,603,903 8/1986 Moscovitch .
4,746,168 5/1988 Bracesco .
4,753,482 6/1988 Warren .
4,776,633 10/1988 Knoblock et al. .
4,783,121 11/1988 Luyk et al. .
4,795,215 1/1989 Shimada .
4,832,408 5/1989 Bertsch et al. .
4,835,801 6/1989 Walpin et al. .
4,840,430 6/1989 Shimada .
4,856,846 8/1989 Lohmeyer .
4,892,356 1/1990 Pittman et al. .
4,898,425 2/1990 Mundy .
4,900,085 2/1990 Tobler .
4,961,708 10/1990 Van Niekerk ..... 434/407 X
4,995,926 2/1991 Urai .
5,050,931 9/1991 Knoblock .
5,085,488 2/1992 Dal Monte .
5,102,196 4/1992 Kaneda et al. ..... 297/452.15
5,152,582 10/1992 Magnuson .
5,176,521 1/1993 McRae ..... 434/407
5,294,181 3/1994 Rose et al. .
5,297,851 3/1994 Van Hekken .
5,314,240 5/1994 Ishi et al. .
5,326,155 7/1994 Wild .
5,333,934 8/1994 Knoblock .
5,338,099 8/1994 Ishi et al. .
5,403,066 4/1995 Drum .
5,407,248 4/1995 Jay et al. .
5,487,591 1/1996 Knoblock .
5,662,381 9/1997 Roosein et al. ..... 297/452.15 X
5,681,093 10/1997 Pfister .

SEAT BACK WITH APERTURE IDENTIFIERS

CROSS REFERENCE TO RELATED APPLICATIONS

This application is a division of U.S. Application Ser. No. 08/953,474 filed Oct. 17, 1997, issued as U.S. Pat. No. 5,951,110 on Sep. 14, 1999 of John P. Conner, et al. entitled CONTOURED PLASTIC SEAT BACK.

BACKGROUND OF THE INVENTION

This invention relates generally to chairs, and in particular to the structure of the chair back. In the past, chair backs have been manufactured which use a pair of structural shells. An inner structural shell is typically used which provides the foundation for the chair back, and provides the structure to which the upholstery is attached. An outer structural shell can optionally be attached to the back of the inner structural shell to conceal the attachment of the upholstery to the inner structural shell. In the past, the inner and outer structural shells have been typically made of plywood. In order to satisfy the customer's desire for a variety of models to choose from, manufacturers have been forced to produce a variety of different chair back models. When the chair backs have utilized inner and outer structural shells, producing a variety of models has required production of both different sets of outer structural shells and different sets of inner structural shells. Production of these different structural shells increases the cost and complexity of manufacturing the chairs.

Prior chair backs have typically had a three-dimensionally curved front surface to provide more comfort to the user of the chair. In the past, in order to create a chair back having a three-dimensionally curved front surface, either the entire plywood shell (front and back) had to be molded into a three-dimensional shape, or molded cushioning or foam had to be attached to the plywood. Molded cushioning or foam, however, is more expensive than unmolded slab ) foam or cushioning. Molding plywood into a three-dimensionally curved shape is also not only expensive, but technically difficult. Ensuring that the curvature of the plywood is acceptably consistent from one chair back to the next is difficult. The storage of three-dimensionally curved plywood shells is also difficult because stacking the shells tends to bend the plywood out of its desired shape. Further, in the past, to use an outer shell with a three-dimensionally curved inner shell has required that the outer shell also be three-dimensionally curved. Molding a plywood outer shell to also be three-dimensionally curved adds further difficulty to making the chair.

The desirability of a chair back having a structure which can simply and inexpensively be altered to produce a variety of chair back models can therefore be seen. The desirability of a chair back having a three-dimensionally curved front surface which does not use expensive molded foam and which overcomes the above difficulties can also be seen.

SUMMARY OF THE INVENTION

The present invention generally overcomes the disadvantages of the prior chair backs as described above. The chair back of the present invention includes a structure which can be used to produce a variety of different models of chair back with minimal complexity and cost.

In one embodiment of the present invention, a chair back includes an inner shell having a three-dimensionally curved front surface and a two-dimensionally curved back surface.

The three-dimensionally curved front surface allows relatively inexpensive unmolded slab foam to be attached thereto while still providing the comfort of a three-dimensionally curved surface to the user. A two-dimensionally curved back surface allows a two-dimensionally curved outer shell to be attached thereto. The two-dimensional curvature of the outer shell allows the outer shell to be manufactured more easily and inexpensively.

According to another embodiment of the present invention, the chair back includes a plastic inner shell having a top edge configured in a first shape. The inner shell includes at least one internal rib adjacent the top of the shell. The internal rib is configured in a shape which is different from the shape of the edge of the inner shell. The internal rib allows the plastic chair back to be cut adjacent the internal rib between the edge of the inner shell and the internal rib to the shape corresponding to the internal rib. If multiple internal ribs are utilized, the chair back can be customized to a plurality of different shapes. In this manner, a single inner shell is produced which can be easily adapted to yield a variety of differently shaped chair back models.

In still another embodiment of the present invention, a chair back includes a body having a front and back, a top, and a pair of sides. Each of the sides joins the top and defines a corner at the junction of the side and top. The body includes an indentation adjacent each of the corners in the back of the body. The indentation is dimensioned to accommodate overlapping fabric which extends around both the side and the top of the body adjacent the corner. The indentations allow an outer shell to be evenly secured to the back of the body without gaps caused by the extra thicknesses of fabric on the back of the body adjacent the corners.

In still another embodiment of the present invention, a chair back includes a plastic body having a front and back. The body defines a plurality of holes extending between the front and back. Adjacent each of the holes is a unique indicia molded into the body. The indicia uniquely identifies each hole and facilitates the manufacturing of different chair backs which utilize the holes for different patterns of ornamentation on the front of the chair back.

These and other objects, advantages, and features of the present invention will be apparent to one skilled in the art in light of the following specification when read in conjunction with the accompanying drawings.

DESCRIPTION OF THE PREFERRED EMBODIMENTS

Figure 1:
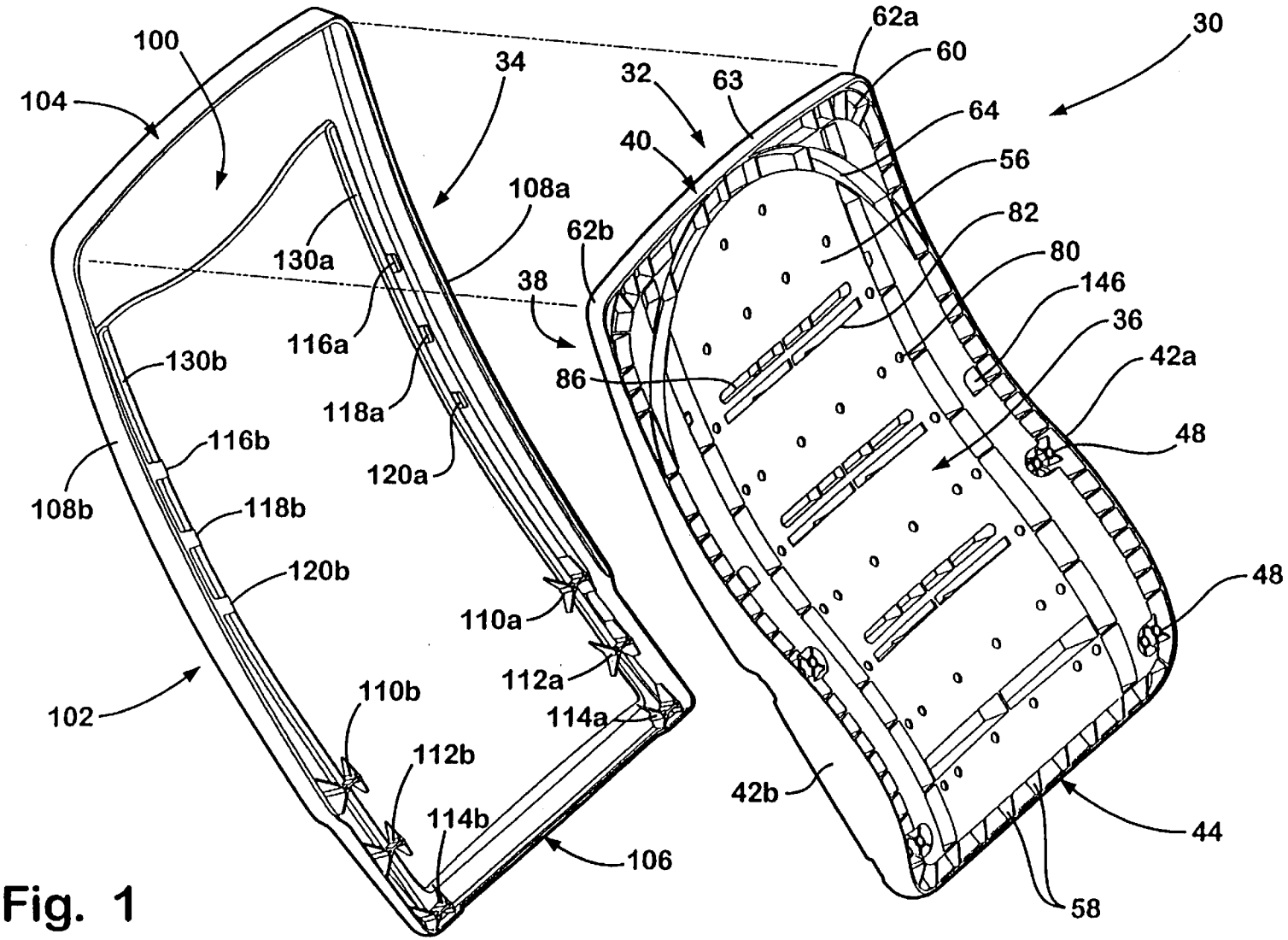
FIG. 1 is a perspective view of an inner and outer shell of a chair back according to a first embodiment of the present invention.
Figure 5:
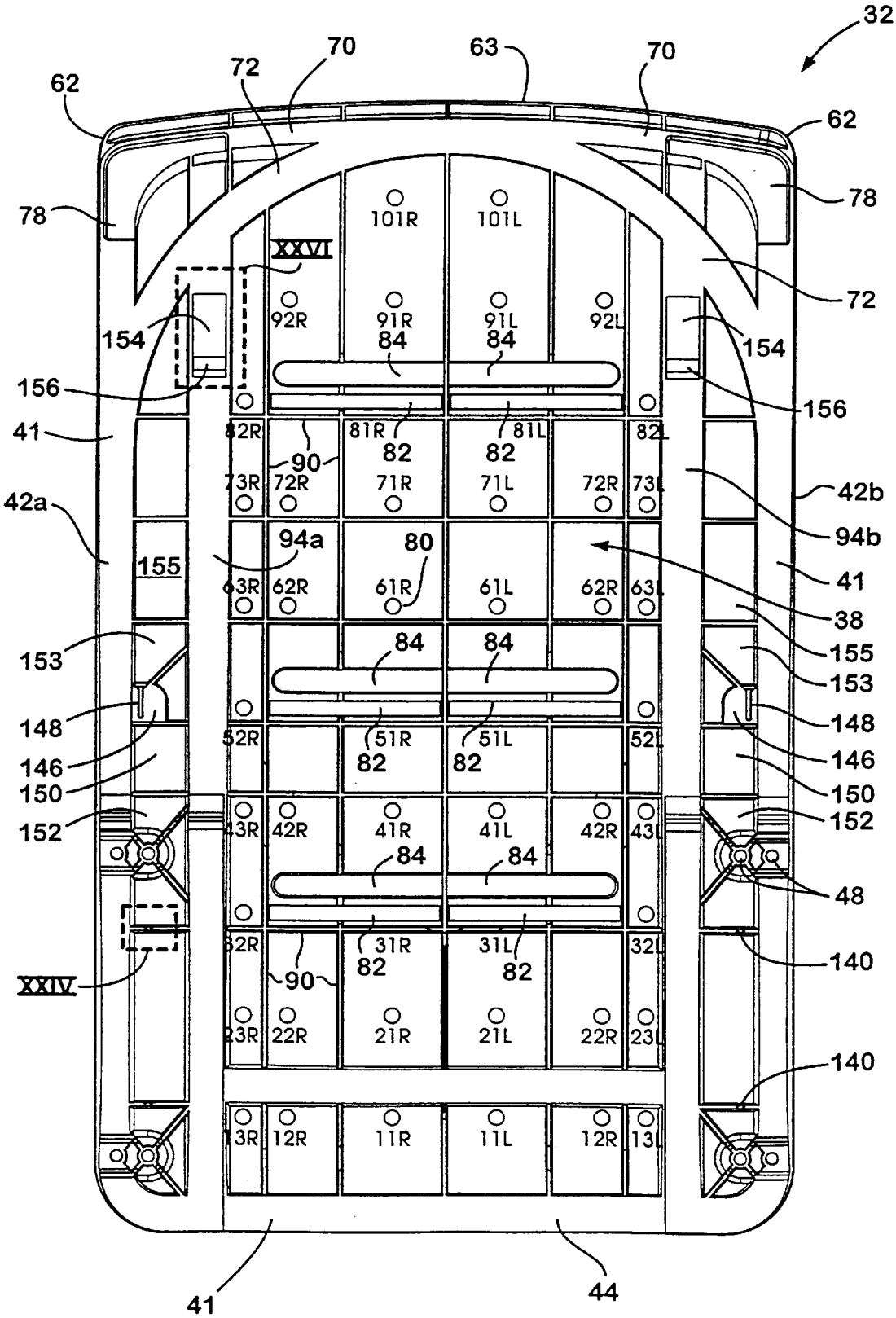
FIG. 5 is a rear, elevational view of the inner shell of FIG. 3.

The present invention will now be described with reference to the accompanying drawings wherein like reference numerals correspond to like elements in the several drawings. A chair back 30 according to one embodiment of the present invention is depicted in FIG. 1. Chair back 30 includes an inner shell or body 32 and an outer shell 34. The terms "inner" and "outer" generally refer to the distance from a user's back such that inner shell 32 is closer to a user's back, while outer shell 34 is further away. Inner shell 32 includes a front 36 and a back 38. For purposes of description herein, the term "front" shall refer to the direction facing a person sitting in a chair which includes the chair back of the present invention. The term "rear" or "back" shall refer to the direction facing away from a user of the chair. Front 36 of inner shell 32 is adapted to be covered by foam, cushioning, or other types of upholstery. Inner shell 32 further includes a top 40, a pair of sides 42*a, b*, and a bottom 44. The upholstery which covers front 36 of inner shell 32 typically extends over sides 42, top 40, and bottom 44 and is secured to inner shell 32 on back side 38. The upholstery is attached to a staple strip 41 which extends around the perimeter of back 38 of inner shell 32 (FIG. 5). Outer shell 34 is then attached to back 38 of inner shell 32, thus concealing the attachment of the upholstery.

Figure 2:
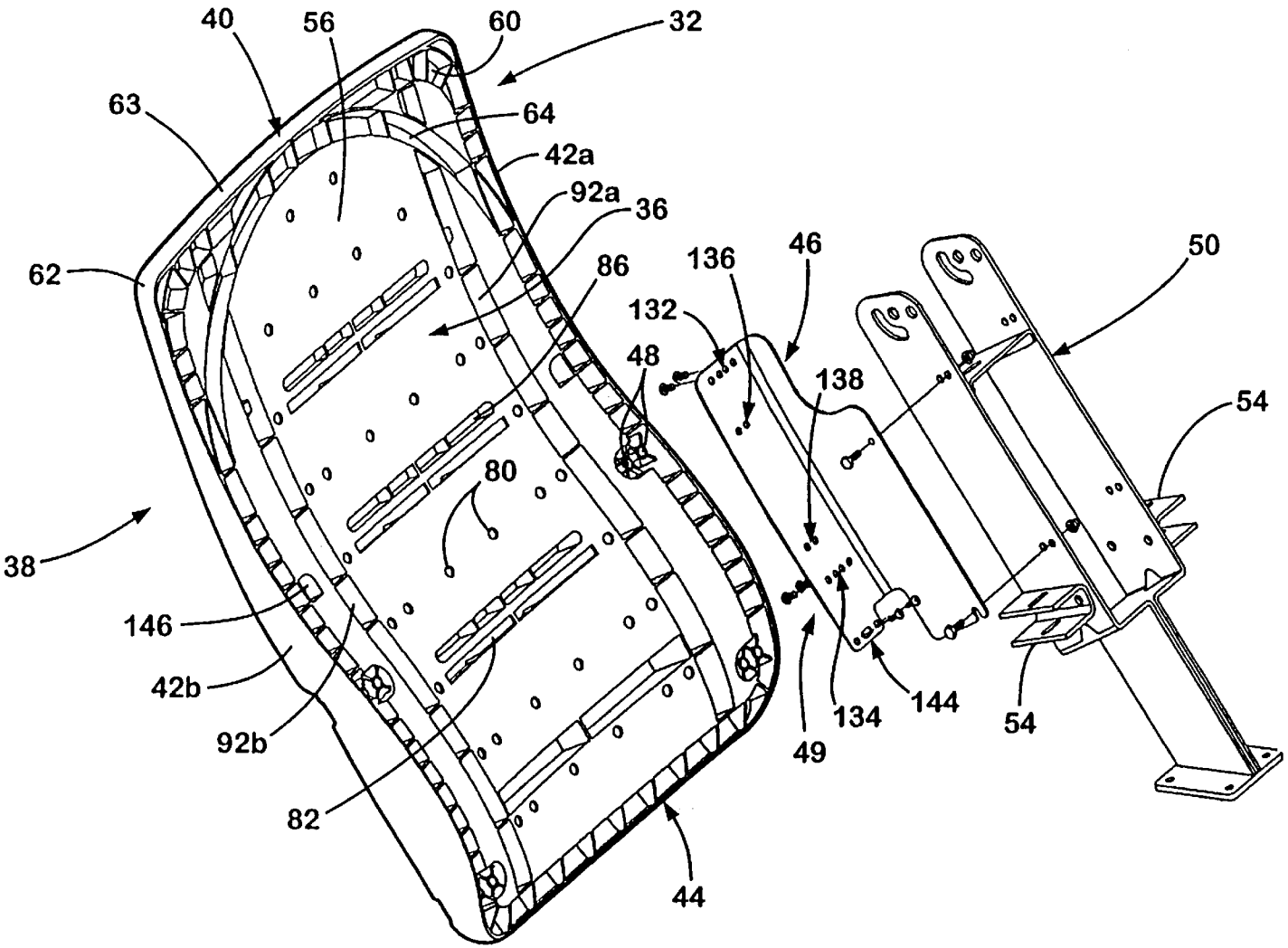
FIG. 2 is an exploded, perspective view of a wing, a leg, and the inner shell.

The partial assembly of a chair embodying the present invention is depicted in FIG. 2. Inner shell 32 is attached to a wing 46 via a plurality of fasteners inserted through fastening apertures 48. Wing 46 is attached to a leg 50 which extends to the floor and supports the chair. While only a single wing 46 and leg 50 are depicted in FIG. 2, a second wing 46 and second leg 50 are used to support inner shell 32 on the side of inner shell 32 opposite that depicted in FIG. 2 (42*b*). A seat 52 (not shown) extends between legs 50 and is supported by seat supports 54 on legs 50. Legs 50 optionally include a pair of seat supports 54 disposed on each side of legs 50 to accommodate a series of chairs aligned in a row, such as in a theater or auditorium. It will be understood by those skilled in the art that a variety of different legs and seats can be used with the present invention.

Figure 3:
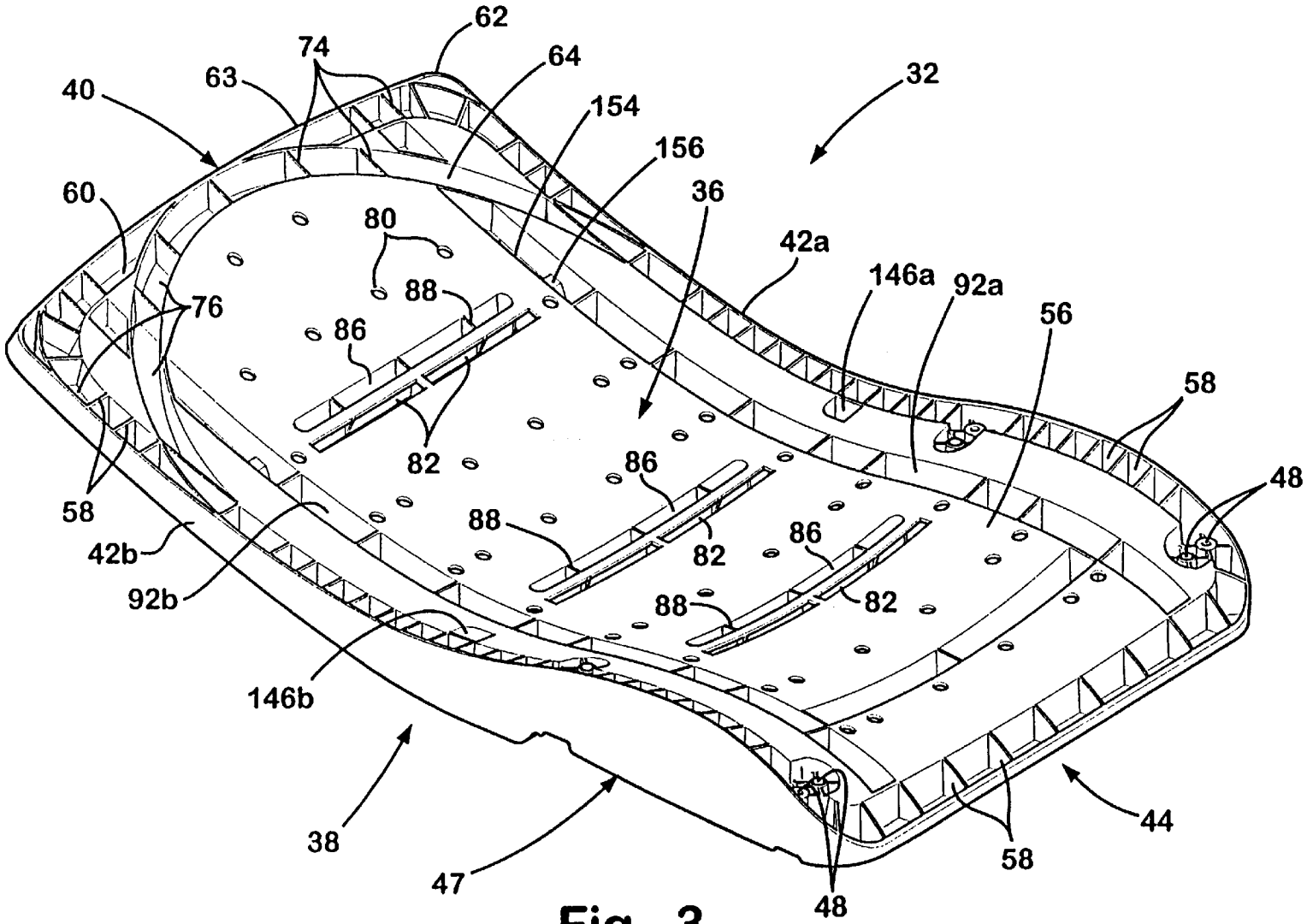
FIG. 3 is a perspective view of an inner shell for a chair back according to a second embodiment in the present invention.
Figure 4:
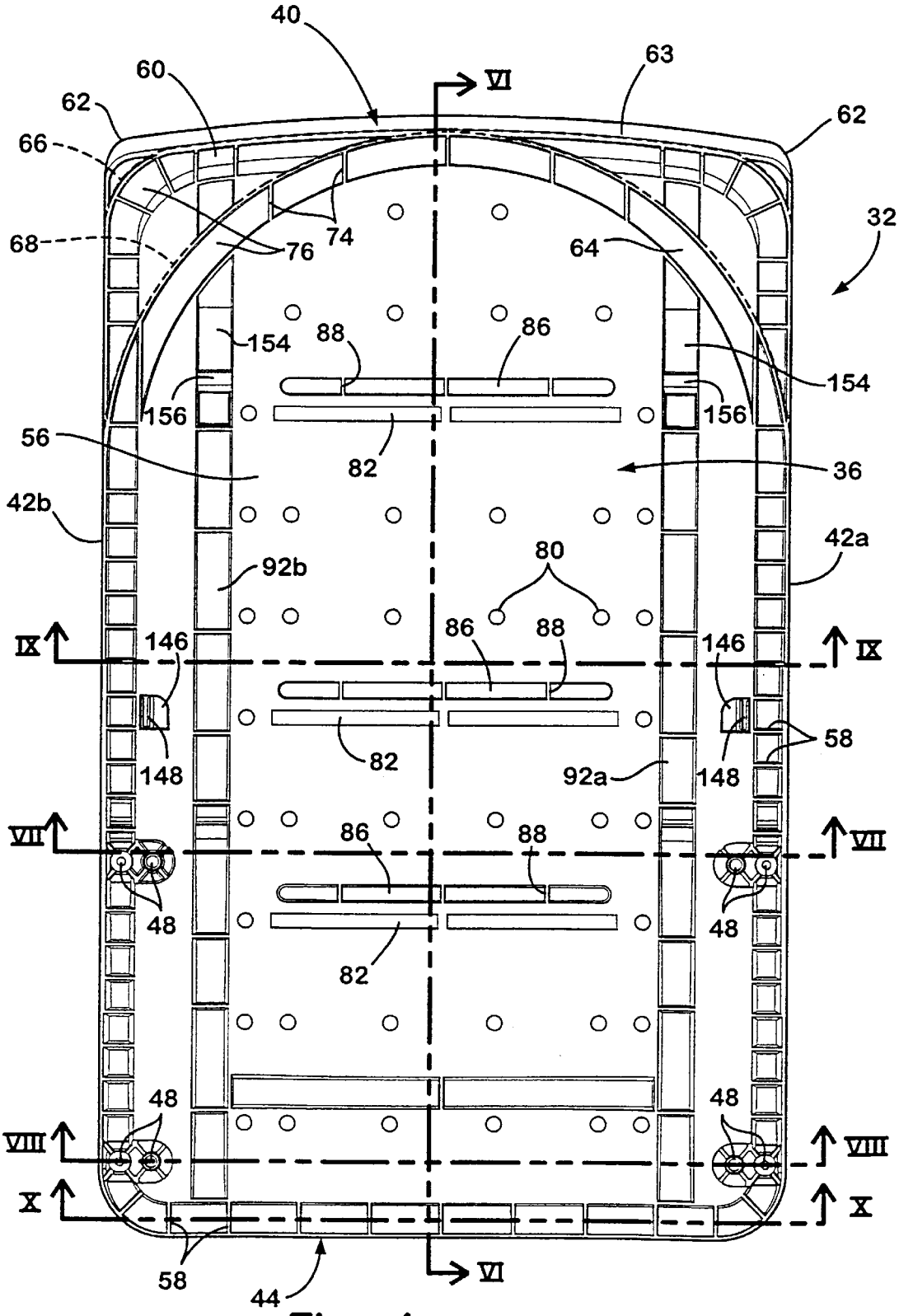
FIG. 4 is a front, elevational view of the inner shell of FIG. 3.
Figure 6:
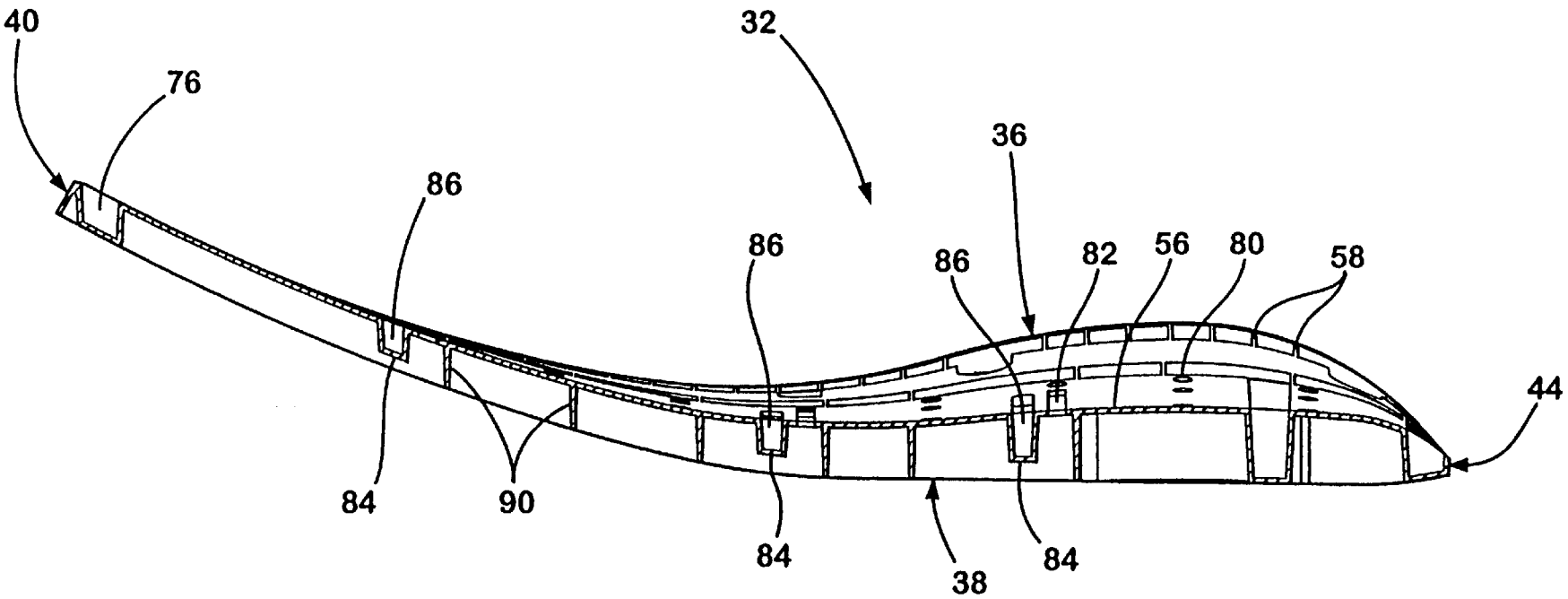
FIG. 6 is a sectional view of the inner shell of FIG. 4 taken along the line VI—VI.

Inner shell 32 is depicted in full in FIGS. 3–5, and in various sections in FIGS. 6–10. Inner shell 32 of chair back 30 is molded from plastic in the preferred embodiment. Front 36 of inner shell 32 is three-dimensionally curved. As used herein, the term "three-dimensionally curved," will refer to a partially or wholly defined surface that is generally curved in both vertical and horizontal cross-sections. A vertical cross-section of inner shell 32 is depicted in FIG. 6, and illustrates the general curvature of front 36. Various horizontal cross-sections of inner shell 32 are depicted in FIGS. 7–10, and illustrate the general curvature of front 36. In both the vertical and horizontal cross sections, the curvature of front 36 is generally convex into inner shell 32. The three-dimensional curvature of front 36 is desirable because it generally conforms more closely to the curvature of a persons back. Front 36 includes a generally solid skin portion 56 disposed in the center of inner shell 32 and extending approximately from top 40 to bottom 44. Solid skin 56 provides a surface for adhesive to be applied to for securing foam or cushioning (not shown) to inner shell 32. Because solid skin 56 is three-dimensionally curved, as is all of front 36, unmolded slab foam can be affixed to front 36 while still presenting to a user a three-dimensionally curved surface. The use of generally more expensive molded foam can thereby be avoided. Around the perimeter of front side 36 of inner shell 32 is an array of corrugation ribs 58 which serve to prevent the upholstery from flowing into the indentations that create staple strip 41 on back side 38.

Figure 7:
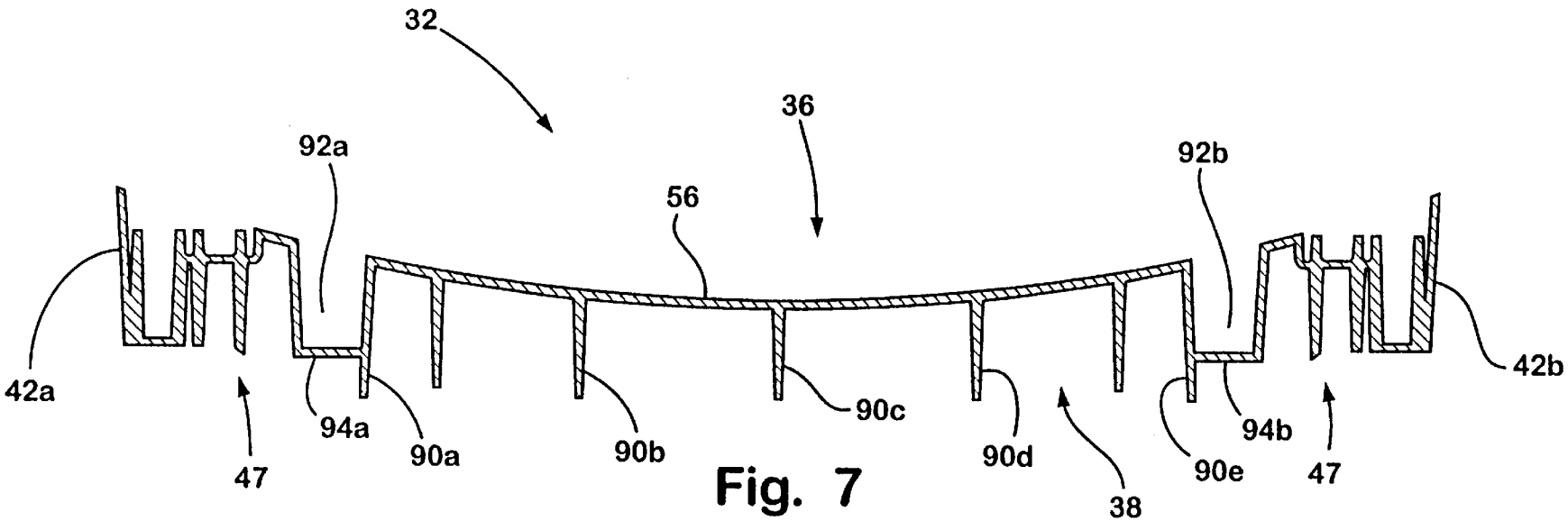
FIG. 7 is a sectional view of the inner shell of FIG. 4 taken along the line VII—VII.
Figure 8:
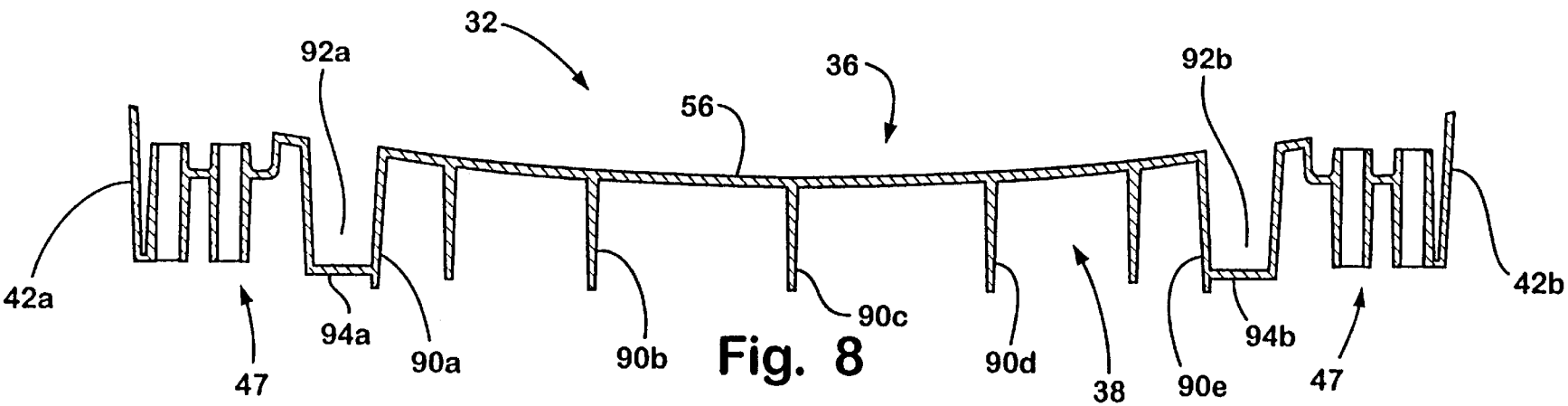
FIG. 8 is a sectional view of the inner shell of FIG. 4 taken along the line VIII—VIII.
Figure 9:
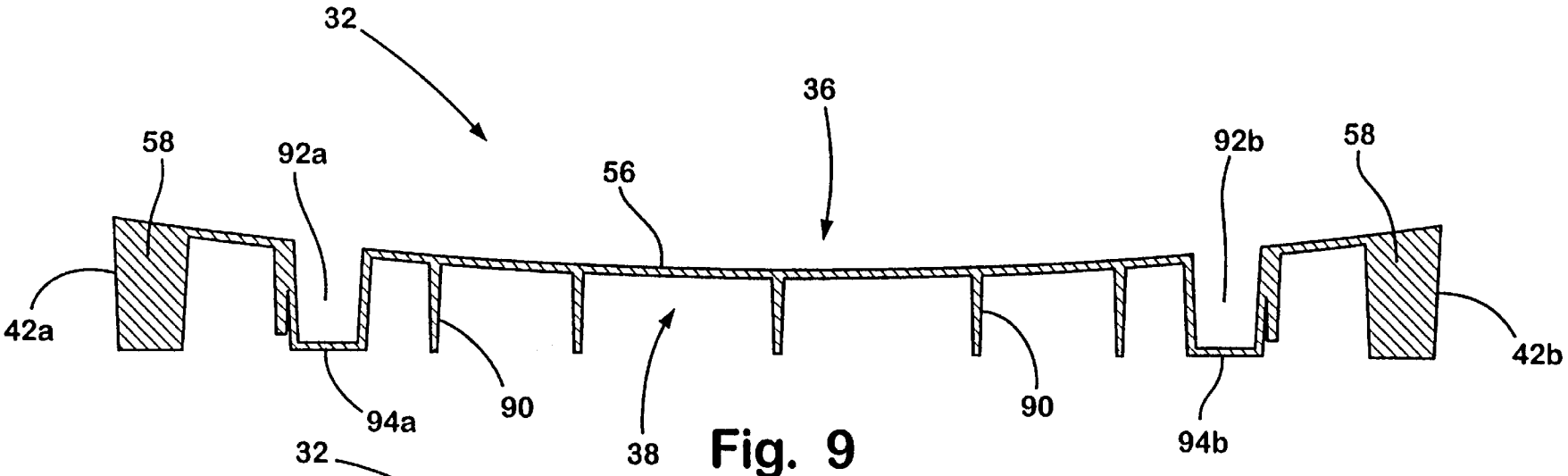
FIG. 9 is a sectional view of the inner shell of FIG. 4 taken along the line IX—IX.

Back 38 of inner shell 32 is two-dimensionally curved. For purposes herein, "two-dimensionally curved" will refer to either a partially or wholly defined surface which is curved either in only horizonal cross-sections or only vertical cross-sections. In the preferred embodiment, back 38 is generally curved in vertical cross-section, and generally straight in horizontal cross-section. This is again illustrated in FIGS. 6–10. While back 38 does not include a solid skin portion 56, and thus does not as completely define a surface as front 36, it can be seen to partially define a curved surface in FIG. 6. The generally straight cross-sections are illustrated in FIGS. 7–10. A series of corrugation ribs 90 extend from front surface 36 and terminate at a distance which generally defines a straight line. In FIGS. 7 and 8, ribs 90*a–e* can be seen to define a straight line.

Figure 10:
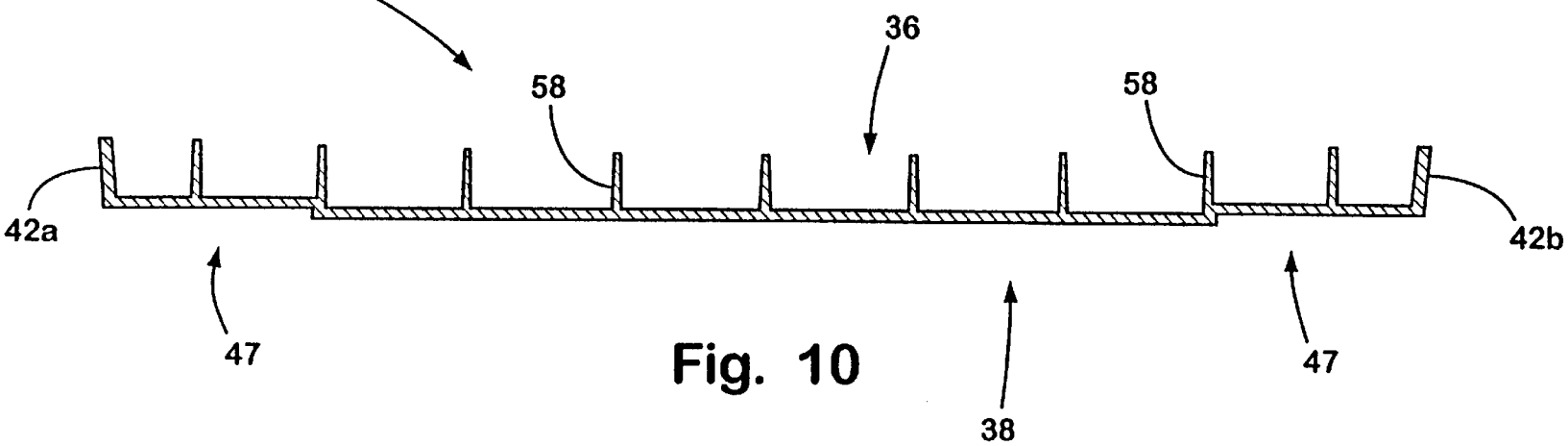
FIG. 10 is a sectional view of the inner shell of FIG. 4 taken along the line X—X.
Figure 11:
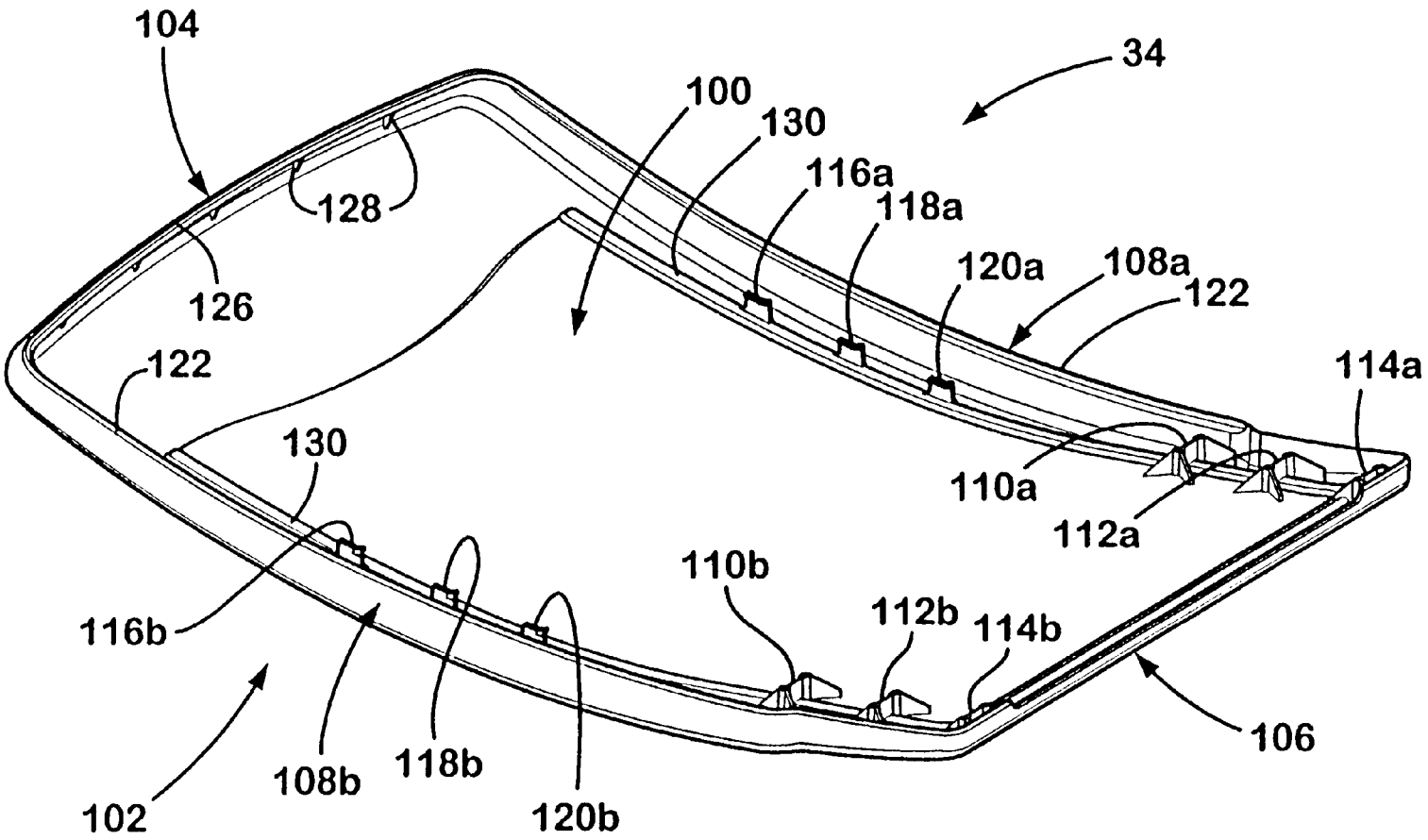
FIG. 11 is a front, perspective view of the outer shell.
Figure 12:
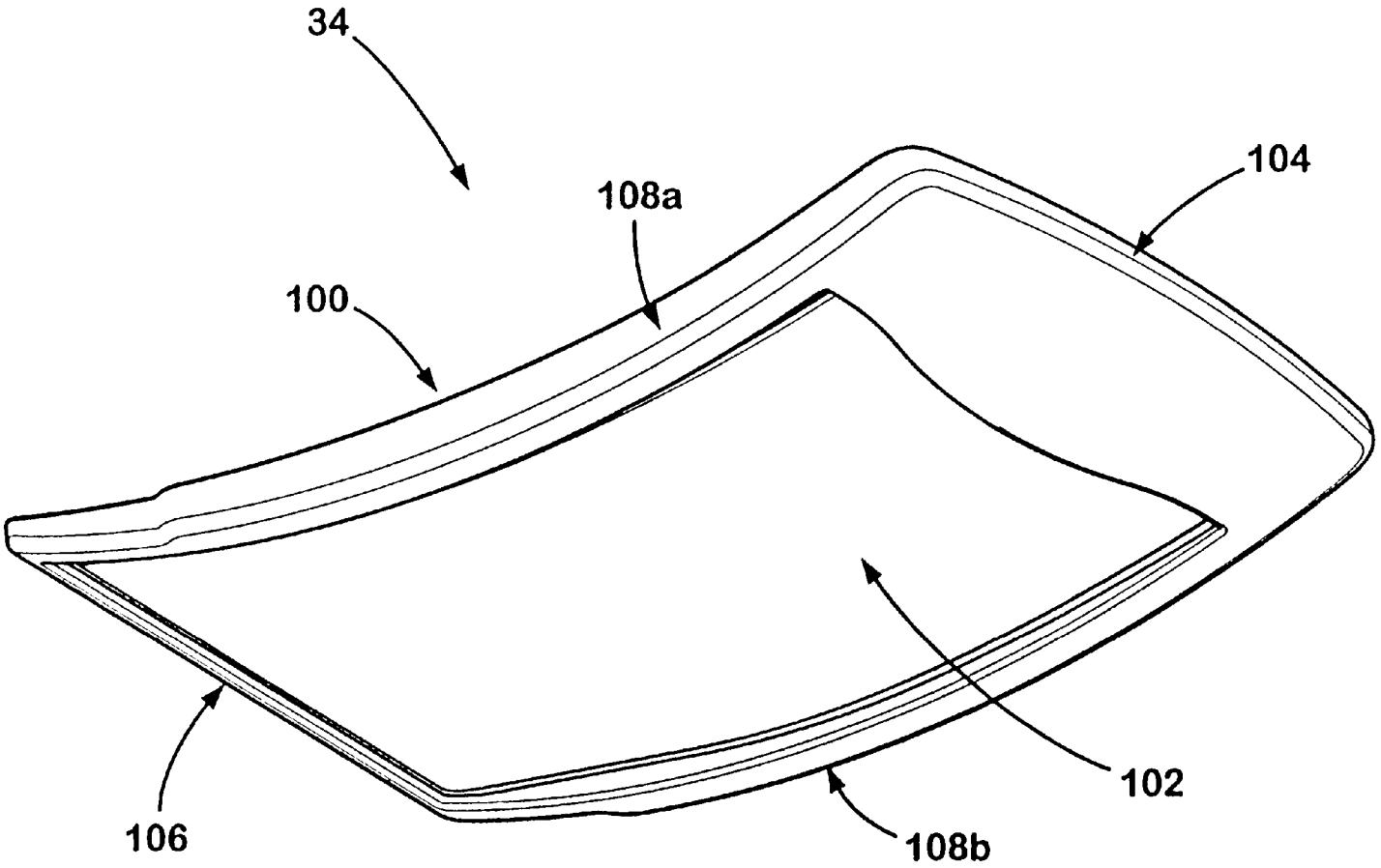
FIG. 12 is a rear, perspective view of the outer shell.
Figure 13:
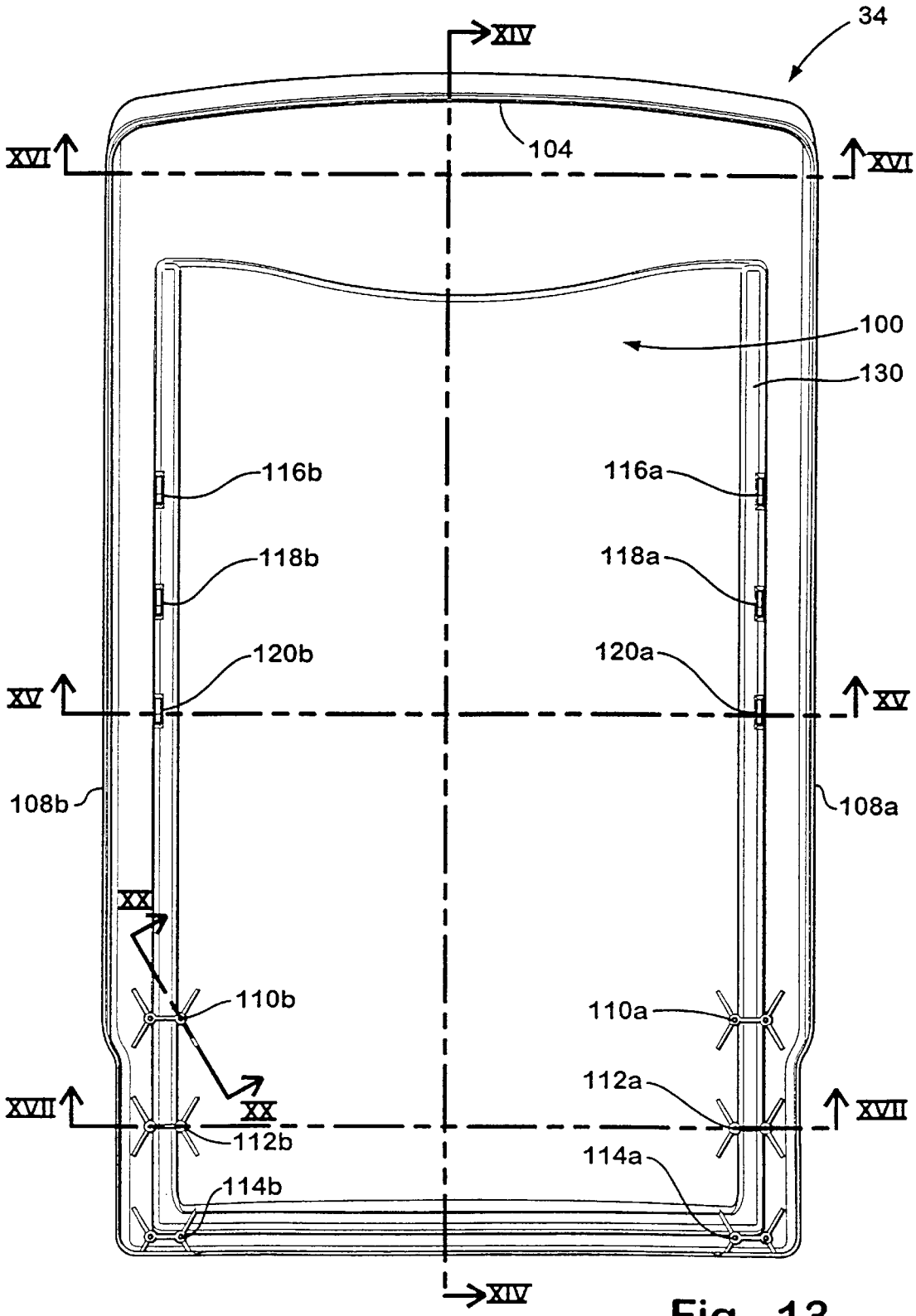
FIG. 13 is a front, elevational view of the outer shell.
Figure 14:
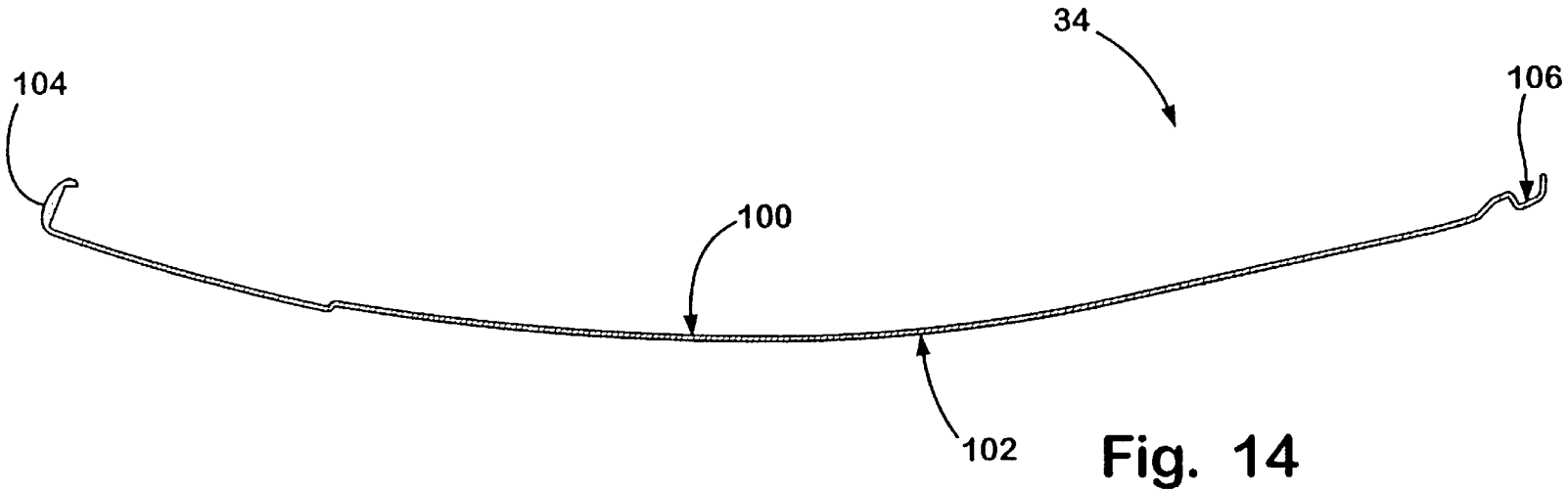
FIG. 14 is a sectional view of the outer shell of FIG. 13 taken along the line XIV—XIV.
Figure 15:
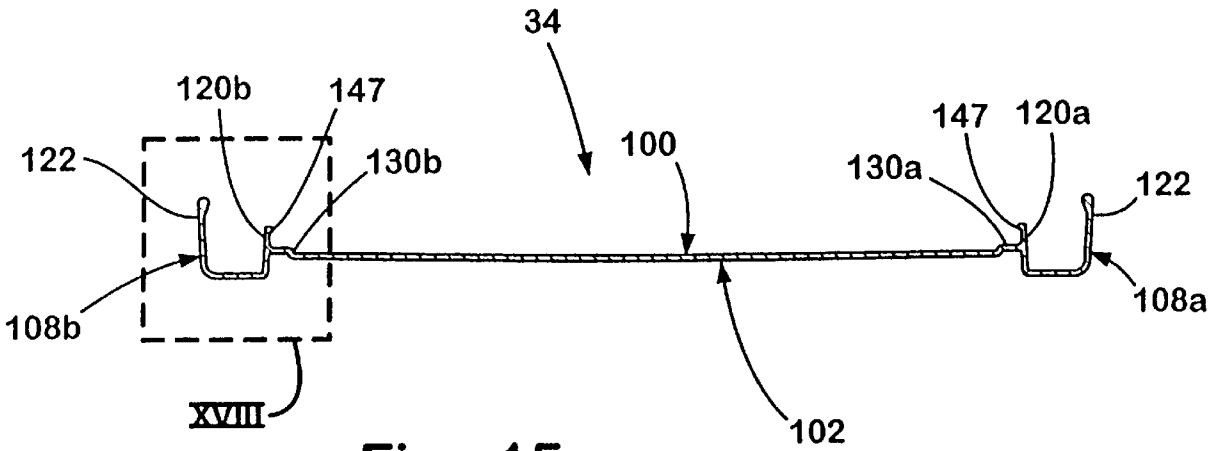
FIG. 15 is a sectional view of the outer shell of FIG. 13 taken along the line XV—XV.
Figure 16:
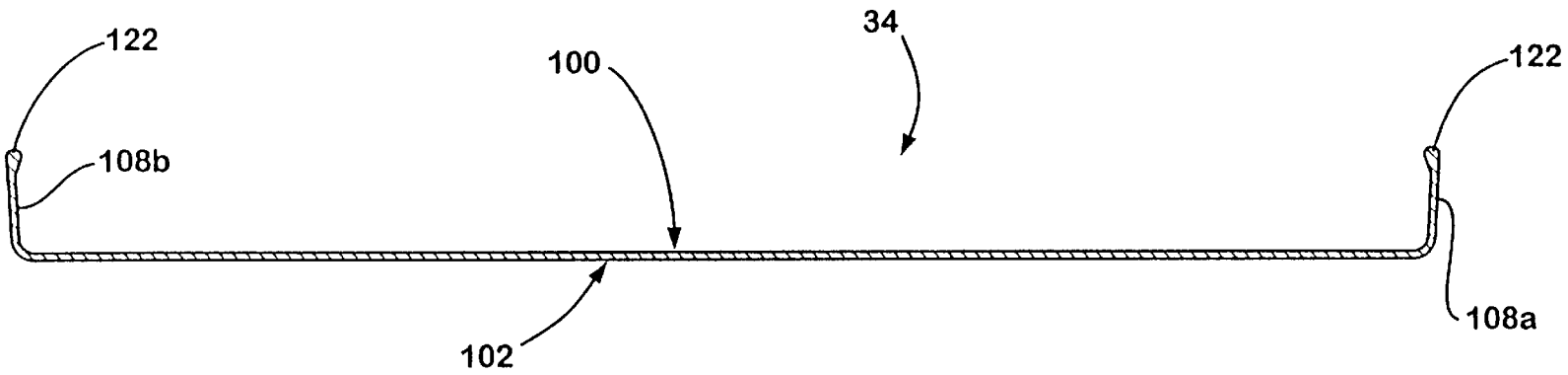
FIG. 16 is a sectional view of the outer shell of FIG. 13 taken along the line XVI—XVI.
Figure 17:
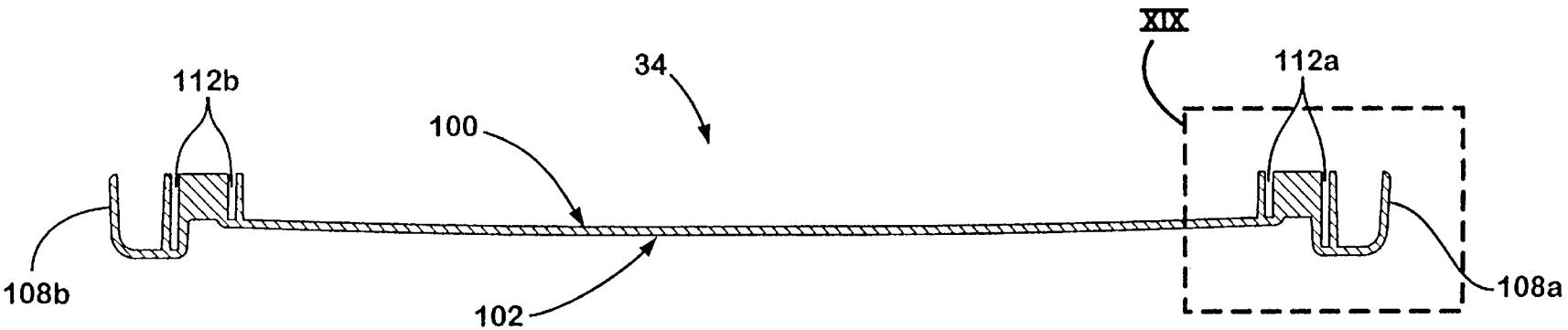
FIG. 17 is a sectional view of the outer shell of FIG. 13 taken along the line XVII—XVII.

Back 38 further includes a pair of indentations 47 adjacent fastening apertures 48 to allow for clearance of wings 46 (FIGS. 7, 8, and 10). Clearances 47 disrupt the generally straight horizontal cross-section of back 38 of inner shell 32. Clearances 47 are filled in by wings 46 which maintains the generally straight cross-section of back 38. The two-dimensional curvature of back 38 enables outer shell 34 to likewise be two-dimensionally curved. Outer shell 34 may be made of either plastic or plywood. If constructed of plywood, it is significantly cheaper to manufacture when two-dimensionally curved as opposed to three-dimensionally curved. The two-dimensional curvature of back 38 of inner shell 32 thus facilitates the manufacture of a more inexpensive chair back.

A first internal rib 60 is disposed in inner shell 32 adjacent a pair of corners 62*a, b* defined by the junction of sides 42*a, b* and a top edge 63 (FIGS. 3–5). First internal rib 60 extends across inner shell 32 from side 42*a* to side 42*b*. A second internal rib 64 is defined in inner shell 32 in the vicinity of first internal rib 60. Second internal rib 64 likewise extends across inner shell 32 from side 42*a* to side 42*b*. Second internal rib 64 merges with first internal rib 60 in the center of inner shell 32 adjacent top edge 63. First internal rib 60 defines a shape different from top edge 63. Similarly, second internal rib 64 defines a shape different from both first internal rib 60 and top edge 63. Internal ribs 60 and 64 are designed to allow top 40 of inner shell 32 to be cut to shapes different from top edge 63. First internal rib 60 defines a first cut line 66, and second internal rib 64 defines a second cut line 68 (FIG. 4). The shape of the top of inner shell 32 can therefore be customized to a plurality of different shapes.

On the back side of inner shell 32, first and second internal ribs 60 and 64 define a planar, staple strip area 70 and 72, respectively (FIG. 5). Staple strip areas 70 and 72 provide a surface to which the fabric or upholstery which is pulled over from the front side of inner shell 32 can be affixed. First and second internal ribs 60 and 64 further include a plurality of transverse ribs 74 visible from front side 36 (FIG. 4). In addition to providing structural reinforcement, transverse ribs 74 prevent foam or cushioning from flowing into recesses 76 defined in the front side of internal ribs 60 and 64. Internal ribs 60 and 64 allow a single molded inner shell to be used to create a plurality of differently shaped chair backs.

Inner shell 32 defines a pair of indentations, or recesses, 78 adjacent corners 62 on back side 38 of inner shell 32 (FIG. 5). Indentations 78 are designed to accommodate the overlapping fabric that extends both over top edge 63 and around sides 42*a, b*. Because the fabric is folded both over top edge 63 and around sides 42*a, b*, the fabric adjacent corners 62*a, b* will have twice as many layers as the rest of the back side of inner shell 32. Without indentations 78, the double thickness of this corner fabric would create an uneven back surface of inner shell 32 that would prevent the snug attachment of outer shell 34 to inner shell 32. By being dimensioned sufficiently deep and sufficiently wide, indentations 78 receive the extra fabric layer, allowing the back of inner shell 32 to be generally even and thereby preventing any gaps which might otherwise be formed between outer shell 34 and inner shell 32 by the double layers of fabric. Indentations 78 are functional only when top edge 63 of inner shell 32 retains its originally molded shape. In other words, customizing top 42 to the different shapes defined by internal ribs 60 and 64 prevents the use of indentations 78.

Inner shell 32 defines a plurality of holes 80 which extend through inner shell 32 from front side 36 to back side 38. Holes 80 are used to secure ornamentation, such as buttons or the like (not shown), to the front side of the chair back. The ornamentation is placed on the front side of the upholstery and includes a fastener which extends through both the upholstery and holes 80. The fasteners, which can be plastic or other suitable material, and which are generally known in the art, are secured to the back side of inner shell 32 to prevent removal from holes 80. Holes 80 are disposed at a plurality of different locations in inner shell 32. Depending upon the height and width of inner shell 32, more or less holes 80 can be included in inner shell 32 as desired. Depending upon what type of configuration of ornamentation is desired for the chair back, none, some, or all of holes 80 may be utilized to secure ornamentation to the chair back. In order to facilitate the manufacturer of chair backs with different configurations of ornamentation, a unique identifier or indicia is molded into inner shell 32 on its back side 38 adjacent each hole 80 (e.g. 41L, 63L; FIG. 5). Different models of chair back ornamentation configurations can be defined by the specific holes 80 through which the ornamentation is secured. The unique identifiers thus allow for easy manufacture of a variety of different ornamentation configurations.

Inner shell 32 further defines a plurality of horizontal slots 82 disposed generally in the center of inner shell 32 (FIGS. 3–5). Slots 82 are disposed at a plurality of different heights along inner shell 32. Slots 82 are designed to allow seams to be created in the upholstery on the front of each chair back. The fabric is pulled through each slot 82 and affixed to a staple strip 84 defined on back 38 above each slot 82. Staple strip 84 is defined by a horizontal indentation 86 in front surface 36 of inner shell 32. Horizontal indentations 86 each include a plurality of vertical ribs for structural reinforcement of staple strip 84. The use of slots 82 to create seams is entirely optional. Thus, a variety of different seam patterns can be created from a single inner shell 32 by varying which one, or ones, of slots 82 are used to create seams.

Back side 38 of inner shell 32 (FIG. 5) includes a gridwork of horizontally and vertically extending ribs 90. Ribs 90 add strength to inner shell 32. Ribs 90 have an increased depth generally in bottom portion 44 of inner shell 32. Ribs 90 substantially prevent inner shell 32 from flexing so that inner shell 32 is generally rigid. Inner shell 32 further includes a pair of vertically extending indentations 92*a, b* defined in front surface 36. Vertically extending indentations 92*a, b* provide additional structural support to inner shell 32, create additional staple strips 94*a, b* on back surface 38, and define a pair of attachment apertures which are used to partially secure outer shell 34 to inner shell 32 as described more fully herein.

Inner shell 32, as mentioned above, is molded from plastic and can be molded to three different heights in the preferred embodiment. Inner shell 32 can be molded from any suitable plastic, but in the preferred embodiment is molded from a 40% talc-filled polypropylene. Inner shell 32 is strong enough to support a user's back without outer shell 34 attached. FIGS. 1 and 2 depict an embodiment of inner shell 32 having a first height, while the remaining figures depict a second embodiment of inner shell 32 having a second, greater height. The embodiment of inner shell 32 depicted in FIGS. 1 and 2 has one fewer row of holes 80 than are present in the embodiment depicted in the remaining figures.

Outer shell 34 is depicted in FIGS. 11–20. Outer shell 34 may either be made of plastic or plywood. The embodiment of outer shell 34 that is made out of plastic is depicted in the drawings herein. The plywood embodiment of outer shell 34 is not depicted in the drawings, but is generally the same as the plastic version, except for the "Z" clip fasteners which are described below. While outer shell 34 may be molded from any of a variety of suitable plastics, in the preferred embodiment outer shell 34 is molded from a high density, UV stabilized polyethylene. Outer shell 34 includes a front side 100, back side 102, top 104, bottom 106, and sides 108*a, b*. Outer shell 34 is two-dimensionally curved to conform to the two-dimensional curvature of back 38 of inner shell 32. Outer shell 34 includes a first set of fastening apertures 10*a, b*, a second set of fastening apertures 112*a, b*, and a third set of fastening apertures 114*a, b*. First set of fastening apertures 110*a, b* are disposed at a first height on outer shell 34, while the second and third sets of fastening apertures are disposed at different heights on outer shell 34.

Outer shell 34 further includes three pairs of fastening tabs 116, 118, and 120 disposed on front side 100 at three different heights. Fastening tabs 116–120, in combination with fastening apertures 110–114 secure outer shell 34 to inner shell 32.

Figure 18:
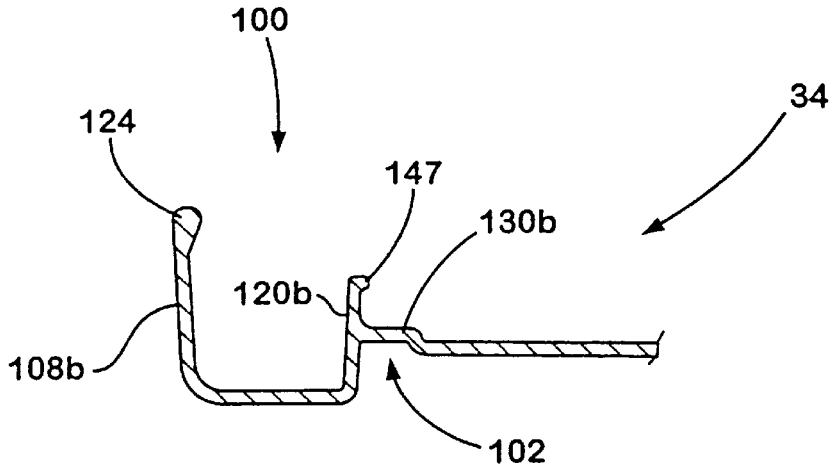
FIG. 18 is an enlarged, partial view of the area labeled XVIII in FIG. 15.
Figure 19:
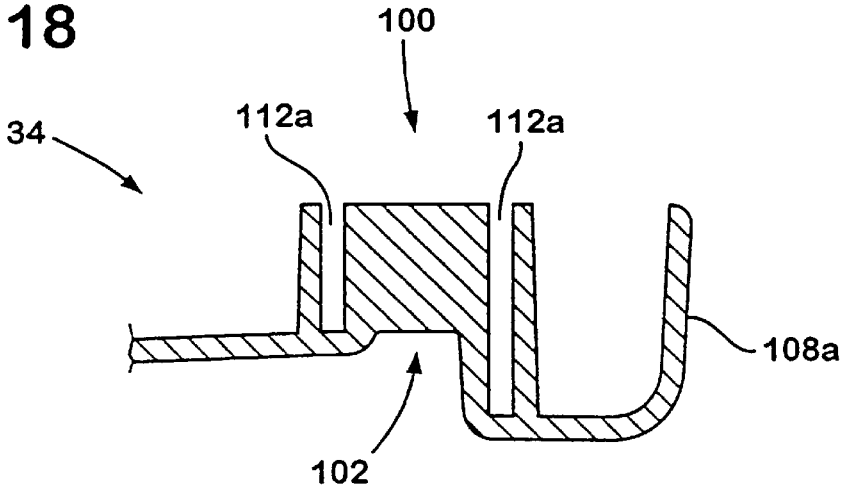
FIG. 19 is an enlarged, partial view of the area labeled XIX in FIG. 17.
Figure 20:
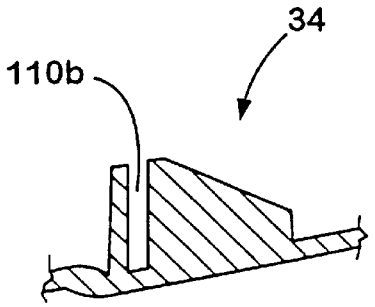
FIG. 20 is a sectional view of the outer shell of FIG. 13 taken along the line XX—XX.

A pair of vertical outer edges 122 are defined in outer shell 34 adjacent sides 108*a, b*. Vertical outer edges 122 include an edge bead 124, as best seen in FIG. 18. Edge bead 124 is an area of increased thickness which allows for better alignment of the outer shell 34 against the upholstered inner shell 32. Edge bead 124 further helps to keep vertical outer edges 122 straight during the molding process and after outer shell 34 is attached to inner shell 32. Top 104 of outer shell 34 includes an edge 126 under which are disposed a plurality of edge ribs 128. Edge ribs 128 increase the strength of top 104 of outer shell 34 and thus prevent outer shell 34 from being peeled away from inner shell 32 after attachment. Edge ribs 128 also contact the upholstered inner shell 32 to assure proper vertical alignment between inner shell 32 and outer shell 34. Top edge 126 of outer shell 34 covers the upholstered inner shell 32 in order to attach the outer shell 34 to inner shell 32 by pulling outer shell 34 into the upholstered foam on inner shell 32. Outer shell 34 further includes a pair of vertically extending reveals 130*a, b* which provide an area for inner shell 32 to make contact with outer shell 34 for alignment. Vertical reveals 130*a, b* also help prevent molding problems, such as sink, for fastening tabs 116–120 and fastening apertures 110–114.

Figure 21:
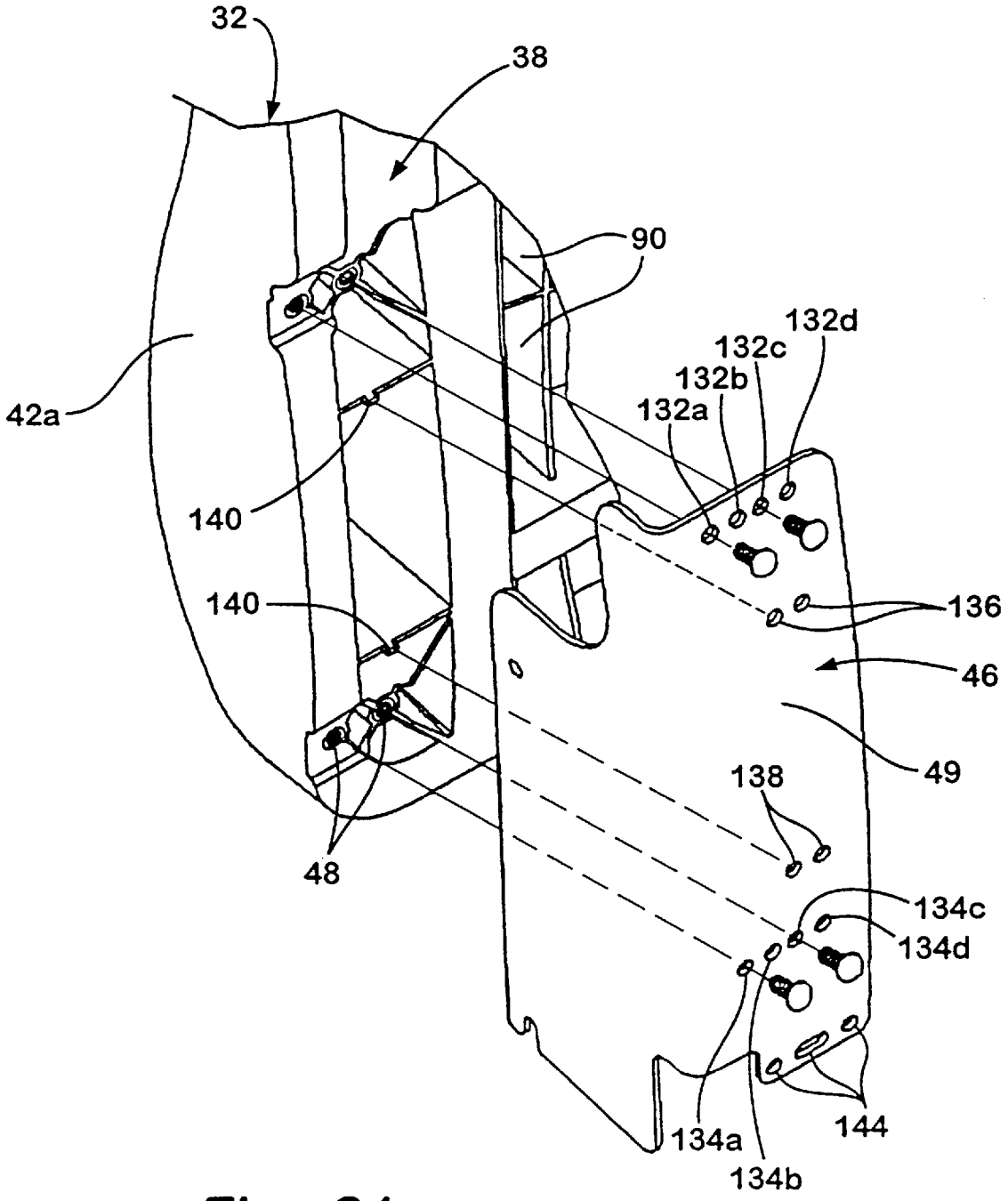
FIG. 21 is a partial, exploded perspective view of the wing of FIG. 2 and the rear side of the inner shell of FIG. 2.
Figure 22:
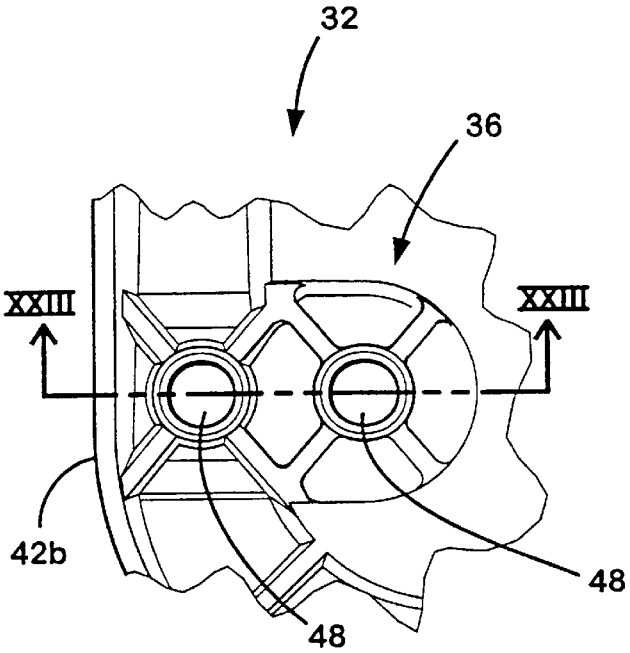
FIG. 22 is an enlarged, partial view of a pair of fastening apertures.
Figure 23:
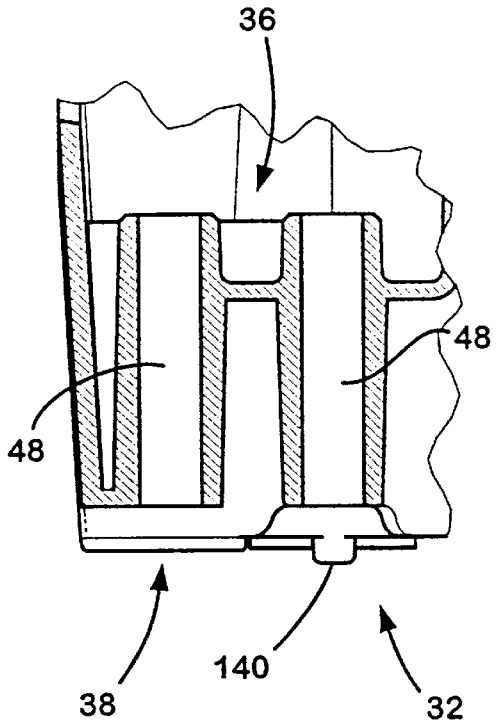
FIG. 23 is a partial, sectional view taken along the line XXIII—XXIII in FIG. 22.

Inner shell 32 and outer shell 34 are secured together via wings 46 (FIG. 21). Wings 46 attach to back side 38 of inner shell 32 via screws, or other suitable fasteners. Wings 46 include a back side 49 which is two dimensionally curved. Wings 46 fill in indentations 47 on the back side of contact inner shell 32 without visible gaps. Wings 46 include an upper set of screw holes 132 and a lower sets of screw holes 134 for attaching wing 46 to inner shell 32. Both upper and lower set of screw holes 132, 134 each include four separate screw holes. Only two of the four screw holes in each set are used at any one given time. The four screw holes allow wing 46 to be attached to inner shell 32 at two different positions, thus creating two different chair widths. Wing 46 is attached in FIGS. 2 and 21 via the screw holes which create a narrow seat (132*a*, 132*c*, 134*a*, and 134*c*). To create a wider seat, the screws should be inserted into the other screw holes in the upper and lower sets of screw holes 132, 134 (132*b*, 132*d*, 134*b*, and 134*d*).

Figure 24:
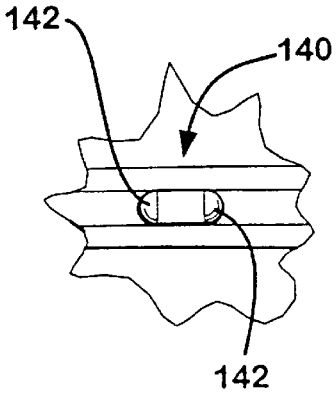
FIG. 24 is a partial, enlarged view of the section labeled XXIV—XXIV in FIG. 5.
Figure 25:
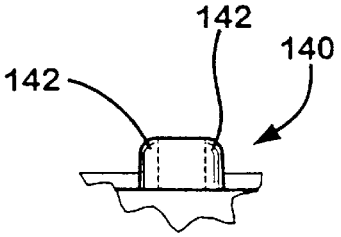
FIG. 25 is a side view of the partial, section depicted in FIG. 24.

Wings 46 further include an upper and lower set of alignment apertures 136 and 138 (FIG. 21). Each set includes two alignment apertures. Alignment apertures 136 and 138 receive a pair of alignment bosses 140 disposed on back side 38 of inner shell 32. Alignment bosses 140 are depicted in detail in FIGS. 24 and 25. Alignment bosses 140 each include a pair of semi-circular protrusions 142 which extend rearwardly from back side 38 of inner shell 32. Semi-circular protrusions 142 are flexible and are dimensioned to fit within alignment apertures 136 and 138 after slight flexing. Alignment apertures 134, 136 and alignment bosses 140 provide a manufacturing assist for the attachment of wing 46 to inner shell 32. Prior to the insertion of screws into upper and lower sets of screw holes 132, 134, wing 46 is aligned with inner shell 32 by inserting alignment bosses 140 into alignment apertures 134, 136. The insertion of alignment bosses 140 into alignment apertures 134, 136 sufficiently retains wing 46 against inner shell 32 to facilitate insertion of screws into upper and lower sets of screw holes 132, 134. Upper and lower sets of alignment apertures 136, 138 each include a pair of alignment apertures which allow for wing 46 to be aligned with inner shell 32 at two different widths. These two different widths correspond to the two different widths which can be created by using the alternative set of screw holes in upper and lower screw holes 132, 134 as described above.

Wings 46 further define three outer shell attachment screw holes 144 along the bottom of wings 46. A middle outer shell attachment screw hole 144 is larger than the two outer screw holes 144, and allows for outer shell 34 to be attached to wing 46 at two different widths corresponding to the above mentioned two different widths. The middle screw hole 144 is used for either width, while selection of one of the outer screw holes 144 determines the width. Outer ) shell attachment screw holes 144 align with fastening apertures 110, 112, or 114 on outer shell 34, depending upon the height at which outer shell 34 is desired to be attached to inner shell 32. As mentioned previously, inner shell 32 is preferably molded with one of three different heights. If outer shell 34 is used with an inner shell 32 having the shortest height, first set of fastening apertures 110*a, b* will be aligned with outer shell attachment screw holes 144 on wing 46 and secured together thereat. If inner shell 32 is molded at a medium height, outer shell 34 is attached to wing 46 via screws inserted through second set of fastening apertures 112 into outer shell attachment screw holes 144. If inner shell 32 is molded at its highest height, outer shell 34 is attached to wings 46 via screws inserted through third set of fastening apertures 114. Thus, a single outer shell 34 can be used with a variety of different inner shells 32 having variable heights.

Outer shell 34 is further secured to inner shell 32 via fastening tabs 116, 118, and 120. Depending upon what height outer shell 34 is being attached to inner shell 32 at, one set of fastening tabs 116, 118, and 120 are inserted into attachment apertures 146 and inner shell 32 (FIGS. 4, 5). If inner shell 32 is molded at its shortest height, fastening tabs 116*a, b* are inserted into attachment apertures 146 in inner shell 32. The fastening tabs are flexible and include a ridge 147 (FIG. 15) which snaps onto a retaining bar 148 in attachment apertures 146. The remaining fastening tabs 118 and 120 fit into compartments 150 and 152 defined by the grid-work formed by ribs 90 (FIG. 5). The fastening tabs in compartments 150 and 152 do not snap onto any portion of inner shell 32. If a medium sized inner shell 32 is molded, fastening tabs 118*a, b* are inserted into attachment apertures 146, and fastening tabs 116 and 120 insert into compartments 152 and 153. If inner shell 32 is molded to be at a maximum height, fastening tabs 120*a, b* are inserted into attachment apertures 146, and fastening tabs 116 and 118 are inserted into compartments 153 and 155. It can therefore be seen that when inner shell 32 is molded at its shortest height, fastening tabs 116*a, b* and first set of fastening apertures 110*a, b* are used to secure outer shell 34 to inner shell 32. When inner shell 32 is molded at a medium height, fastening tabs 118*a, b* and second set of fastening apertures 112*a, b* are used to secure outer shell 34 to inner shell 32. When inner shell 32 is molded at its tallest height, fastening tabs 120*a, b* and third set of fastening apertures 114*a, b* are used to secure outer shell 34 to inner shell 32.

Outer shell 34 can alternatively be made of plywood. When outer shell 34 is constructed of plywood, fastening apertures 110, 112, and 114 remain, but fastening tabs 116, 118, and 120 are replaced with a pair of "Z" clips (not shown). A pair of "Z" clips are attached to the front side of outer shell 34 at a location which aligns them with a pair of "Z" clip apertures 154 defined in inner shell 32 (FIGS. 3–5).

Figure 26:
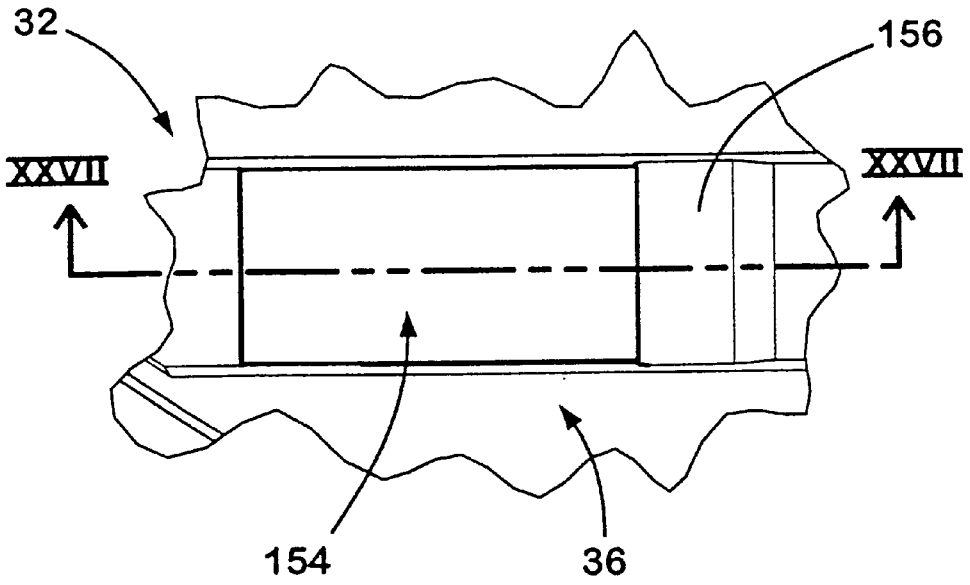
FIG. 26 is a partial, enlarged view of the area labeled XXVI in FIG. 5.
Figure 27:
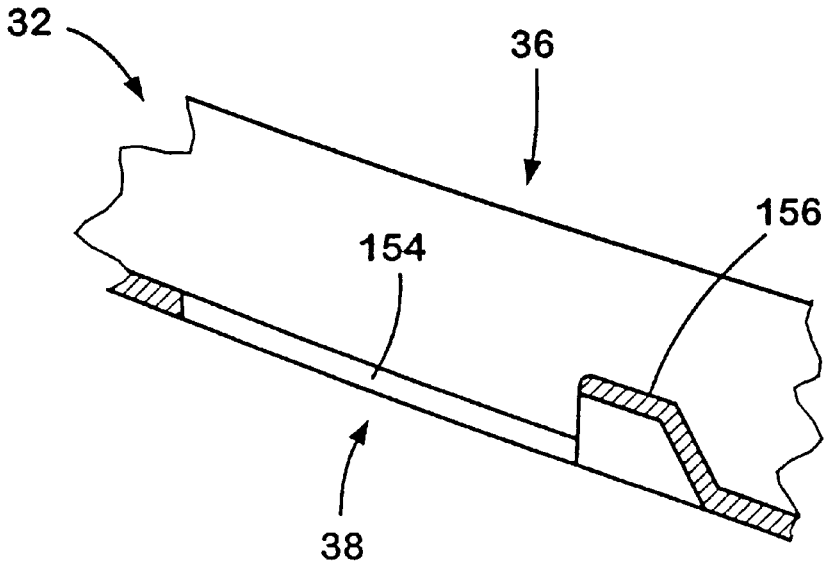
FIG. 27 is a sectional view of the structure depicted in FIG. 26 taken along the line XXVII—XXVII.

"Z" clip apertures are shown in detail in FIGS. 26 and 27. The "Z" clips, which are essentially hooks, insert into "Z" clip apertures 154 and are then slid downwardly to abut against a "Z" bar 156. Gravity, in combination with the frictional abutment of "Z" bar 156 against the "Z" clip, helps retain outer shell 34 against inner shell 32. The "Z" clips are used in combination with fastening apertures 110, 112, and 114 when outer shell 34 is made of plywood. To attach a plywood outer shell 34 to inner shell 32 at different heights, the "Z" clips are simply attached to outer shell 34 at different heights, and the appropriate set of fastening apertures 110, 112, and 114, are used. When top 40 of inner shell 32 has been cut along either first or second internal rib 60, 64 to a shape different than top edge 63, outer shell 34 is made of plywood in the preferred embodiment to allow outer shell 34 to be correspondingly cut.

Because inner shell 32 is made of plastic in the preferred embodiment, the unaided use of screws in fastening apertures 48 may cause cracking or creep in the inner shell over time. In order to prevent this, a threaded, tubular spacer and a T-nut (not shown) are placed in each fastening aperture 48 prior to the insertion of the screws. The T-nut and spacer resist the cracking and creeping tendency of the plastic caused by the screws. The T-nut and spacer may also be used, but are not required, in the fastening apertures 110–114 on outer shell 34.

While the present invention has been described in terms of the preferred embodiments depicted in the drawings and discussed in the above specification, it will be understood by one skilled in the art that the present invention is not limited to these particular preferred embodiments, but includes any and all such modifications that are within the spirit and scope of the present invention as defined in the appended claims.

The embodiments of the present invention in which and exclusive property or privilege is claimed are defined as follows:

1. A chair back, comprising:

a plastic body having a front and a back, said front including a surface adapted to allow upholstery to be secured thereto, said body defining a plurality of holes extending between said front and back for securing ornamentation on said upholstery to said body, said body including a plurality of indicia molded on said back of said body adjacent said plurality of holes, said indicia being unique for each said hole such that the indicia can be used to specify the particular ornamentation pattern for the upholstery.

2. The chair back of claim 1 wherein said body has a top, a bottom, and a pair of sides, said body further including a staple strip adjacent said top, said bottom, and said pair of sides, said staple strip disposed on said back of said body.

3. The chair back of claim 2 further including an outer shell adapted to be secured to said back of said body, said outer shell including a plurality of fastener holes defined at different heights on said outer shell such that said outer shell can be secured to said body at a plurality of different heights.

4. The chair back of claim 3 wherein said body defines a plurality of internal ribs adjacent said top, said plurality of internal ribs defining a plurality of different shapes to which said body may be cut.

5. The chair back of claim 2 wherein said body further defines a set of apertures adapted to receive a set of fasteners for securing said body to a pair of wings, each of said wings being attached to a leg which supports said chair back on the ground.

6. The chair back of claim 5 wherein said wings are adapted to be secured to said body at a plurality of different positions.

7. The chair back of claim 6 further including an insert and a spacer inserted into each of said apertures, said insert and said spacer substantially preventing said plastic chair back from cracking and creeping in the vicinity of said apertures.

8. The chair back of claim 7 further including at least one alignment boss on said plastic chair back which inserts into an alignment aperture on one of said wings for aligning said wing with said body.

9. The chair back of claim 2 wherein said holes are defined in said body in a series of rows positioned at different heights in said body.

10. The chair back of claim 9 wherein each of said unique indicia include a multiple digit number, the first digit of each said multiple digit number being the same for all of the holes defined in the same row, and the first digit of each of said multiple digit numbers being different for all of the holes that are defined in different rows.

11. The chair back of claim 2 wherein some of said holes are circular and some of said holes are elongated.

12. The chair back of claim 1 wherein said unique indicia are numbers.

13. The chair back of claim 1 wherein said holes are circular.

14. The chair back of claim 1 wherein some of said holes are circular and some of said holes are elongated.

15. The chair back of claim 1 wherein said holes are defined in said body in a series of rows positioned at different heights in said body.

16. The chair back of claim 15 wherein each of said unique indicia include a multiple digit number, the first digit of each said multiple digit number being the same for all of the holes defined in the same row, and the first digit of each of said multiple digit numbers being different for all of the holes that are defined in different rows.

17. The chair back of claim 16 wherein at least some of said unique indicia further include letters.

18. The chair back of claim 15 wherein said holes are circular.

19. The chair back of claim 15 wherein some of said holes are circular and some of said holes are elongated.

20. The chair back of claim 1 wherein said unique indicia include both numbers and letters.

* * * * *

UNITED STATES PATENT AND TRADEMARK OFFICE

CERTIFICATE OF CORRECTION

PATENT NO. : 6,042,187
APPLICATION NO. : 09/292246
DATED : March 28, 2000
INVENTOR(S) : Conner et al.

It is certified that error appears in the above-identified patent and that said Letters Patent is hereby corrected as shown below:

Column 1
Line 38, delete “)” after “slab”

Column 6
Line 65, “10*a, b*” should be --110*a, b*--

Column 8
Line 15, delete “)” after “Outer”

Column 10
Claim 8, Line 18, “7” should be --5--

Signed and Sealed this

Second Day of September, 2008

JON W. DUDAS
*Director of the United States Patent and Trademark Office*